US009706310B2

(12) United States Patent
Xu et al.

(10) Patent No.: US 9,706,310 B2
(45) Date of Patent: Jul. 11, 2017

(54) ACOUSTIC DEVICE

(71) Applicants: Yunxia Xu, Shenzhen (CN); Bin Cai, Shenzhen (CN)

(72) Inventors: Yunxia Xu, Shenzhen (CN); Bin Cai, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 14/985,953

(22) Filed: Dec. 31, 2015

(65) Prior Publication Data

US 2016/0225362 A1 Aug. 4, 2016

(30) Foreign Application Priority Data

Feb. 2, 2015 (CN) ..... 2015 2 0072902

(51) Int. Cl.

| | |
|---|---|
| ***H04R 9/02*** | (2006.01) |
| ***H04R 1/02*** | (2006.01) |
| ***H04R 1/28*** | (2006.01) |
| ***G10K 11/00*** | (2006.01) |
| ***H04R 9/04*** | (2006.01) |

(52) U.S. Cl.

CPC ..... *H04R 9/025* (2013.01); *G10K 11/002* (2013.01); *H04R 9/045* (2013.01); *H04R 1/021* (2013.01); *H04R 1/025* (2013.01); *H04R 1/2888* (2013.01); *H04R 2209/022* (2013.01); *H04R 2209/024* (2013.01)

(58) Field of Classification Search

CPC ..... H04R 1/021; H04R 1/025; H04R 1/2888; H04R 7/14; H04R 7/20; H04R 9/06; H04R 2201/029; H04R 9/025; H04R 2209/022; H04R 2209/024

See application file for complete search history.

(56) References Cited

U.S. PATENT DOCUMENTS

2014/0301587 A1* 10/2014 Ji ..... H04R 1/025 381/332

* cited by examiner

*Primary Examiner* — Matthew Eason
(74) *Attorney, Agent, or Firm* — Na Xu; IPro, PLLC

(57) ABSTRACT

One embodiment of the invention discloses an acoustic device having a housing including a receiving space and a sound hole communicating with the receiving space; a vibration unit received in the receiving space; a magnetic circuit unit driving the vibration unit to vibrate; wherein, the vibration unit includes a first part away from the sound hole and a second part close to the sound hole; and the first part is driven by a higher magnetic force generated by the magnetic circuit unit than the second part.

8 Claims, 2 Drawing Sheets

ACOUSTIC DEVICE

FIELD OF THE INVENTION

One embodiment of the invention is related to an acoustic device, and more particularly to a speaker box with high audio performance.

DESCRIPTION OF RELATED ART

In modern consumer electronics, audio capability is playing an increasingly larger role as improvements in digital audio signal processing and audio content delivery continue to happen. There is a range of consumer electronic devices that are not dedicated or specialized audio playback devices, yet can benefit from improved audio performance. For instance, smart phones are ubiquitous.

In a typical acoustic device, such as a speaker or a speaker box, a sound radiation surface is provided for generating sound. Generally, the sound radiation surface is a membrane or a diaphragm which is activated by an electrified voice coil. While activated, the sound radiation surface vibrates and produces audible sounds. Recently, the speaker box often defines a sound hole on the sidewall of the speaker box. When operates the speaker box and the voice coil vibrates, a sound resistance in an area close to the sound hole is less than that in an area away from the sound hole. Thus, an unbalance vibration occurred while the voice coil vibrating, which results in a distortion of the sound generated from the speaker box, and some other defaults in the speaker box.

Therefore, an improved acoustic device is provided in the embodiment of the present disclosure to solve the problem mentioned above.

Figure 1:
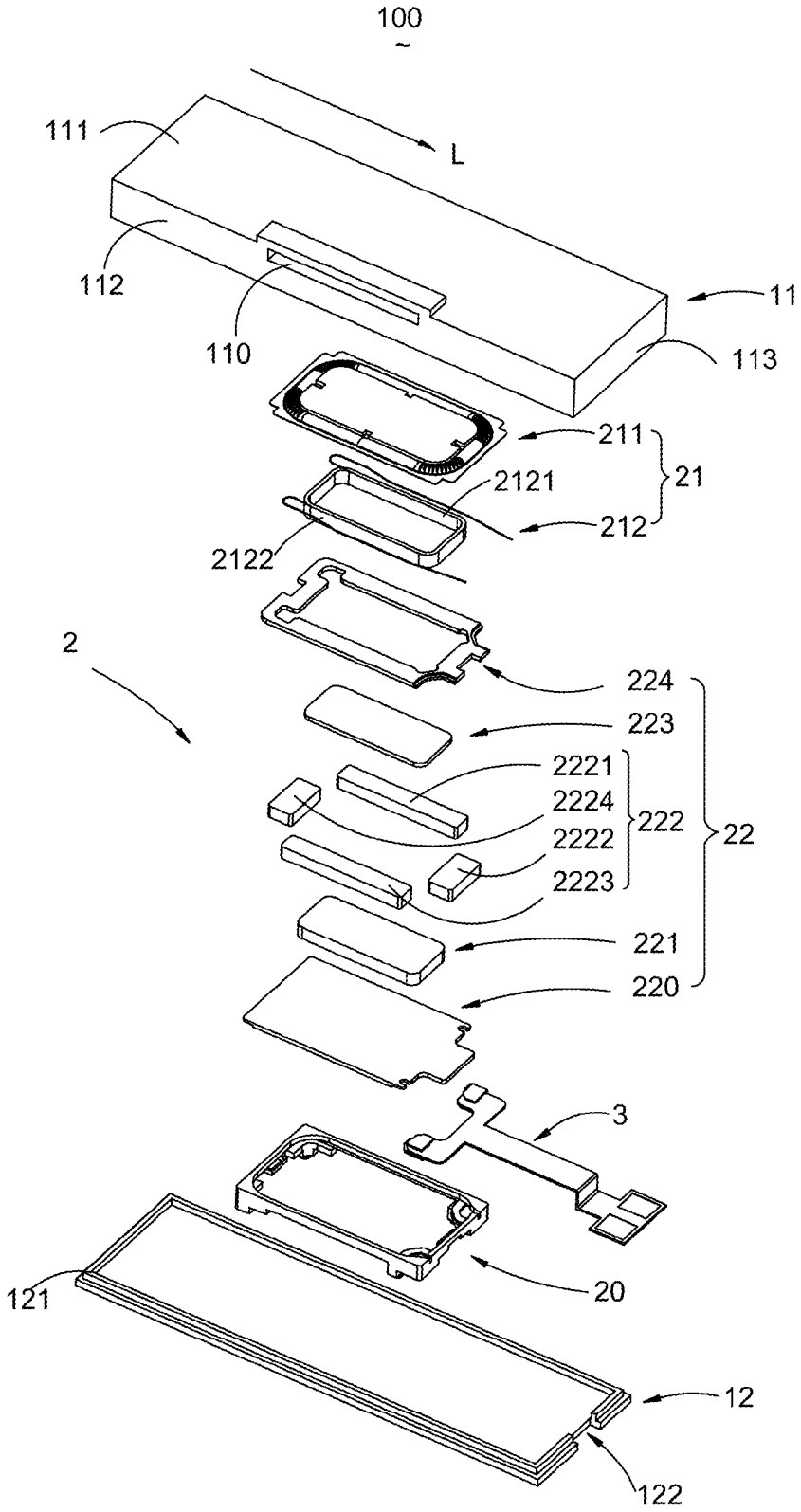
FIG. 1 is an exploded isometric view of an acoustic device related to the present invention.

Many aspects of the embodiment can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Reference will now be made to describe an exemplary embodiment of the present invention in detail. In this section we shall explain several exemplary embodiments of this invention with reference to the appended drawings. Whenever the shapes, relative positions and other aspects of the parts described in the embodiment are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 2:
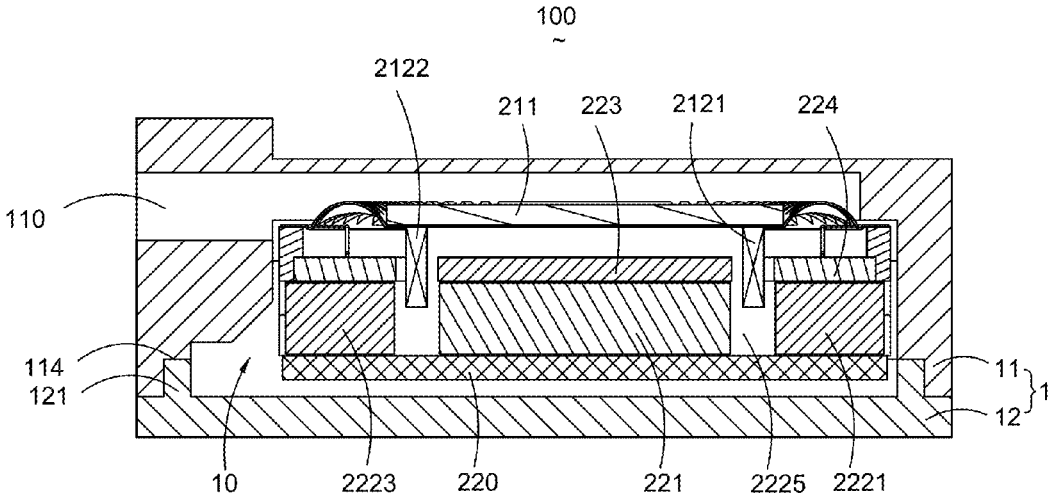
FIG. 2 is a cross-sectional view of the acoustic device in FIG. 1.

Referring to FIG. 1 and FIG. 2, an acoustic device 100 according to an exemplary embodiment includes a housing

1 having a cover 11 and a mounting plate 12 assembled with the cover 11 for forming a receiving space 10, a speaker unit 2 received in the receiving space 10 and an electric terminal 3 electrically connected with the speaker unit 2 and extends out of the receiving space 10 for connecting to outer circuit.

The cover 11 has a rectangular box shape, and includes a rectangular top wall 111 defining a length direction L, a pair of first sidewalls 112 extending substantially perpendicular to the top wall 111 in the length direction L and a pair of second sidewalls 113 extending substantially perpendicular to the top wall 111 in a direction perpendicular to the length direction L. A through window 110 for transmitting sound generated by the speaker unit 2 to outside is formed in one of the first sidewalls 112 or one of the second sidewalls 113. The through window 110 has a slit shape and communicates with the receiving space 10. In this embodiment, the through window 110 is formed in the first sidewall 112 in the length direction L. The first sidewalls 112 and second sidewalls 113 are provided with depressions 114 that are recessed in a direction toward the top wall 111.

The mounting plate 12 has a rectangular shape with a dimension substantially equal to the top wall 111. The mounting plate 12 has a ring shaped projection 121 protruding toward the top wall 111 of the cover 11 for accommodating into the depressions 114 to assemble with the cover 11. The mounting plate 12 further defines a cut-out portion 122 in one side thereof, via which the electronic terminal 3 leads out of the cover 11.

The speaker unit 2 includes a vibration unit 21, a magnetic circuit unit 22 driving the vibration unit 21 to vibrate and a frame 20 for containing the magnetic circuit unit 22. The vibration unit 21 comprises a diaphragm 211 and a voice coil 212 connected with the diaphragm 211 for driving the diaphragm 211 to vibrate. Optionally, the voice coil 212 may be connected to the diaphragm 211 via a medium which is directly connected with the diaphragm 211. In other words, the voice coil 212 may be connected to the diaphragm 211 directly or indirectly. Therefore, the term "connect" here means to connect something to another via a medium or to connect something to another directly without any medium. The voice coil 212 includes a first part 2121 away from the through window 110 of the cover 11 that is driven by a higher magnetic force, and a second part 2122 close to the through window 110 that is driven by a lower magnetic force. With such a configuration, the unbalance vibration in the speaker box can be avoided.

The magnetic circuit unit 22 comprises a base board 220, a main magnetic conduction member 221 disposed on a center portion of the base board 220, an auxiliary magnetic conduction member 222 disposed on a periphery portion of the base board 220, a main pole plate 223 attached on the main magnetic conduction member 221 and an auxiliary pole plate 224 attached on the auxiliary magnetic conduction member 222. The base board 220 is made of magnetic conduction materials for effectively conducting magnetic fluxes.

In this embodiment, the main magnetic conduction member 221 may be a permanent magnet and has a cuboid shape. The auxiliary magnetic conduction member 222 includes a first magnet 2221, a second magnet 2222, a third magnet 2223 and a fourth magnet 2224 surrounding the main magnetic conduction member 221 and four gaps 2225 that communicate with each other formed therebetween. In this embodiment, the first and third magnets 2221, 2223 are respectively parallel to a lengthwise side of the main magnetic conduction member 221, and the second and fourth magnets 2222, 2224 are parallel to a short side of the main magnetic conduction member 221. The first magnet 2221 is disposed away from the through window 110 and the third magnet 2223 is disposed close to the through window 110. The first magnet 2221 and the third magnet 2223 are symmetrical about a central axis of the main magnetic conduction member 221 in the length direction L. In this embodiment, the first magnet 2221 may be made of a first magnetic material, and the third magnet 2223 may be made of a second magnetic material. A maximum magnetic energy product of the first magnetic material is higher than that of the second magnetic material. With such construction of the first and third magnets, a magnetic force generated between the main magnetic conduction member and the first magnet is higher than that generated between the main magnetic conduction member and the second magnet.

When assembled, the voice coil 212 is received in the gaps 2225. The first part 2121 of the voice coil 212 is received in a gap 2225 between the main magnetic conduction member 221 and the first magnet 2221; the second part 2122 of the voice coil 212 is received in a gap 2225 between the main magnetic conduction member 221 and the third magnet 2223. Thus, the first part 2121 of the voice coil is driven by a higher magnetic force generated between the main magnetic conduction member 221 and the first magnet 2221. The second part 2122 of the voice coil is driven by lower magnetic force generated between the main magnetic conduction member 221 and the third magnet 2223. With such a configuration, the unbalance vibration in the speaker box can be avoided. In this embodiment, the second and fourth magnets 2222, 2224 are made of the same material.

While the present disclosure has been described with reference to the specific embodiment, the description of the disclosure is illustrative and is not to be construed as limiting the disclosure. Various of modifications to the present disclosure can be made to the exemplary embodiment by those skilled in the art without departing from the true spirit and scope of the disclosure as defined by the appended claims.

What is claimed is:

1. An acoustic device, comprising:

a cover having a top wall, a plurality of sidewalls connected with the top wall, and a through window in the sidewall;

a mounting plate assembled with the cover for forming a receiving space;

a speaker unit received in the receiving space and including a vibration unit and a magnetic circuit unit for driving the vibration unit to vibrate; wherein, the vibration unit includes a first part away from the through window and a second part close to the through window;

the magnetic circuit unit comprises a base board, a main magnetic conduction member disposed at a center of the base board, and an auxiliary magnetic conduction member disposed at a periphery of the base board for forming a magnetic gap together with the main magnetic conduction member; wherein, the auxiliary magnetic conduction member includes a first segment disposed away from the through window and parallel to the main magnetic conduction member and a second segment disposed close to the through window and parallel to the main magnetic conduction member; a magnetic force generated between the first segment and the main magnetic conduction member is higher than that between the second segment and the main magnetic conduction member, such that the first part is driven by a higher magnetic force than the second part.

2. he acoustic device of claim 1, wherein, the cover has a rectangular box shape and defines a length direction;

the through window is formed on the sidewall in the length direction and has a slit shape.

3. The acoustic device of claim 1, wherein, the first segment is made of a first magnetic material and the second segment is made of a second magnetic material, a maximum magnetic energy product of the first magnetic material is higher than that of the second magnetic material.

4. The acoustic device of claim 1, wherein, the first segment and the second segment are symmetrical about a center axis of the main magnetic conduction member in the length direction.

5. An acoustic device, comprising:

a housing including a receiving space and a sound hole communicating with the receiving space;

a vibration unit received in the receiving space;

a magnetic circuit unit driving the vibration unit to vibrate; wherein, the vibration unit includes a first part away from the sound hole and a second part close to the sound hole;

the magnetic circuit unit comprises a base board, a main magnetic conduction member disposed at a center of the base board, and an auxiliary magnetic conduction member disposed at a periphery of the base board for forming a magnetic gap together with the main magnetic conduction member; wherein, the auxiliary magnetic conduction member includes a first segment disposed away from the sound hole and parallel to the main magnetic conduction member and a second segment disposed close to the sound hole and parallel to the main magnetic conduction member; a magnetic force generated between the first segment and the main magnetic conduction member is higher than that between the second segment and the main magnetic conduction member, such that the first part is driven by a higher magnetic force than the second part.

6. The acoustic device of claim 5, wherein, the cover has a rectangular box shape and defines a length direction;

the sound hole is formed on a sidewall of the housing in the length direction and has a slit shape.

7. The acoustic device of claim 1, wherein, the first segment is made of a first magnetic material and the second segment is made of a second magnetic material, a maximum magnetic energy product of the first magnetic material is higher than that of the second magnetic material.

8. The acoustic device of claim 1, wherein, the first segment and the second segment are symmetrical about a center axis of the main magnetic conduction member in the length direction.

* * * * *